US006734433B1

(12) United States Patent
Meunier et al.

(10) Patent No.: US 6,734,433 B1
(45) Date of Patent: May 11, 2004

(54) INONIZATION CHAMBER, MEASURING SEQUENCE FOR THE ACTIVITY OF A GAS EMITTING RADIATION β AND METHOD USING SAME

(75) Inventors: Gilles Meunier, Talant (FR); Christian Le Serrec, Marcilly s/Tille (FR); Franck Bachelet, Dijon (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/958,041

(22) PCT Filed: Apr. 18, 2000

(86) PCT No.: PCT/FR00/01001

§ 371 (c)(1),
(2), (4) Date: Oct. 3, 2001

(87) PCT Pub. No.: WO00/63948

PCT Pub. Date: Oct. 26, 2000

(30) Foreign Application Priority Data

Apr. 20, 1999 (FR) ..... 99 04962

(51) Int. Cl.[7] ..... H01J 47/02
(52) U.S. Cl. ..... 250/380; 250/374; 250/375
(58) Field of Search ..... 250/374, 375, 250/379, 380

(56) References Cited

U.S. PATENT DOCUMENTS

| | | | | |
|---|---|---|---|---|
| 3,746,861 A | | 7/1973 | Gant et al | |
| 4,445,037 A | | 4/1984 | Anderson | |
| 4,598,204 A | | 7/1986 | Bras | |
| 4,857,740 A | * | 8/1989 | Atac | 250/374 |

OTHER PUBLICATIONS

Overhoff Technology Corporation, "Tritum and Other Radiogas Monitors".

* cited by examiner

*Primary Examiner*—Constantine Hannaher
*Assistant Examiner*—Timothy Moran
(74) *Attorney, Agent, or Firm*—Thelen Reid & Priest, LLP

(57) ABSTRACT

The present invention concerns an ionization chamber cylindrical in shape comprising an anode (35) formed by a central rod in current-carrying material and a cathode (38) in current-carrying material around the said anode, both connected to two elements of a mechanical base of the said chamber in which two cylindrical end shields (36, 37) in non-magnetic and insulating material are centred on the anode (35) and arranged at right angles to this at both ends, the cathode (38) being made up of a spooled wire on the outer rim of these two end shields (36, 37).

14 Claims, 8 Drawing Sheets

65
52
ALARM A
ALARM B
STATUS
ANALOG A
ANALOG B
OUTSIDE CONTROL
RESERVE
FLOW
TEMPERATURE
PRESSURE
RESERVE
RS232
RS485
RELAYS
RELAYS
RELAYS
4/20 mA
4/20 mA
TOR
TOR
4/20 mA
4/20 mA
4/20 mA
4/20 mA
µP
RAM
EPROM
RTC
DSP
ALIM 200 V
CHAUFFAGE COMMUT.
62
63
53
+12V
-12V
+5V
0V
57
R1
R2
Rc
COM
COM
60
61
220 V
56
58
51
34

INONIZATION CHAMBER, MEASURING SEQUENCE FOR THE ACTIVITY OF A GAS EMITTING RADIATION β AND METHOD USING SAME

This application is a national phase of PCT/FR00/01001 which was filed on Apr. 18, 2000, and was not published in English.

TECHNICAL FIELD

The present invention concerns an ionization chamber, an activity measuring channel for a β radiation gas emitter, which can for example be a tritium detection chamber, and an implementation process for this.

STATE OF PREVIOUS TECHNIQUES

An ionization chamber tritium channel such as described in the document in reference [1] at the end of the description, is used to measure the activity of a β radiation gas emitter in a given gaseous environment, for example in a glove box, a laboratory ventilation circuit or furthermore a stack control in a nuclear building. The ionization chamber which is immersed directly in the environment to be controlled, provides a current in proportion to the activity to be quantified. Process electronics facilitate the measurement of amperage between $10^{-14}$ and $10^{-8}$ A.

Such a measuring channel is made up of an ionization chamber, which plays the role of detector, a pre-amplifier, signal processing electronics, and a link cable between the pre-amplifier and the processing electronics.

The ionization chambers of today's technology are of two types:

- the massif anode and cathode chambers—a chamber of this type illustrated in FIG. 1 comprises a central electrode 10 in nickel brass forming an anode, a shell 11 in brass forming a cathode, a filler hole 12, an end 13 for adapting a pre-amplifier, a guard ring 14 in nickel brass, insulators 15 in polystyrene and O-rings 16.

Such chambers are used for the measurement of low activity, for example below 5,000 Admissible Contamination Limit. These are generally of large size, for example about 10,000 $cm^3$.

- Anode and/or light cathode chambers—a chamber of this type illustrated in FIG. 2 comprises removable electrodes 20 and 21, in practice a central anode 20 and a cathode 21 formed by a brass, copper or aluminium grid and is fitted with a filler hole 22. In this case it is set out in a shell 23 in steel, with two openings 24 and 25 respectively for filling and draining. Furthermore it comprises an O-ring 26, a guard ring 27, insulators 28 in polystyrene, an outlet 29 to a high voltage and an outlet 30 to a pre-amplifier.

Such chambers are dedicated to measuring higher activities (glove box, or even certain manufacturing processes). They are generally small-volume chambers, for example 100 $cm^3$. The use of light electrodes for the measurement of intense activity is aimed at limiting the surface contamination of electrodes which generates considerable background noise.

In the channels of today's technology, a pre-amplifier assembled directly on an ionization chamber facilitates amplifying the current which can be very low up to a satisfactory level so that it can be transmitted through the connector cable to the processing electronics.

Two methods are currently used for the signal process electronics to quantify the current due to ions produced by the β radiation and picked up on the electrodes of the ionization chamber:

- capacitor load (load quantifier)
- high resistance voltage read on the terminals in which the generated current circulates.

Electronics of the first type are acknowledged to be more accurate because drift over a period of time is lower. Electronics of the second type are less complicated to implement and less expensive.

What is more the signal processing electronics must have considerable measuring scope (from $10^{-14}$ A to $10^{-8}$ A, or from $10^{-12}$ A to $10^{-6}$ A), which means an automatic rating change-over.

Such measuring channels of today's technology have numerous drawbacks:

- the prohibitive cost of electronic systems allowing measurement of very low currents,
- the important background noise of light electrode chambers,
- in certain cases these chambers are inoperative after one single measurement,
- the impossibility of decontamination by baking (400° C.) under vacuum of existing ionization chambers,
- the lack of heater systems in all chambers, in particular those of less than 100 $cm^3$ in volume—measurements are in fact more stable when the atmosphere in the vicinity of the chamber can be heated (stabilization at a given temperature, convection stirring, impact on hygrometry, etc.),
- the need to replace a complete chamber+base+connector unit in case of breakdown or after important contamination which is very expensive, as today's chambers are in fact welded to their connection systems and to their mechanical base so as to limit noise generated by the contact resistors,
- the need to have recourse to guard rings in order to correctly delimit lines of electric fields in the ionization chamber, as certain pieces of the framework of today's chambers (excluding cathode, anode and connector)are in fact made in conductive material,
- the absence of leaktightness of the mechanical base which is the interface between the ionization chamber and the connector,
- generation of a not inconsiderable weight (today about 1 kilo) of contaminated waste at the time of replacing a complete detector (chamber+base+connector),
- the multiplication of measuring channels (250 measurement lines constantly operational in a base nuclear installation treating tritium) which involve important installation costs—a complete measuring channel (detector+process electronics+cable) costs between 72 kF (about 14 kF for a detector of 100 $cm^3$ and about 58 kF for the electronics) plus about 126 kF (68 kF for a detector of 10,000 $cm^3$ and about 58 kF for the electronics).

The purpose of the present invention is to overcome the shortcomings of first generation devices.

ACCOUNT OF THE INVENTION

The present invention concerns an ionization device cylindrical in shape comprising an ionization chamber with an anode made up of a central rod in current-carrying material, and a cathode in current-carrying material around the said anode, both connected to two elements of a mechanical base of the said chamber, two cylindrical end shields in non-magnetic and insulating material, centred on the anode and arranged at right angles to this at both ends.

As the cathode is made up of a spooled wire on the outer rim of these two end pieces, typified in that the base is removable, the lower extremity of the anode and the two ends of the wire making up the cathode connected to pin plugs arranged on the lower end plate, being suitable for insertion in the sockets arranged on a contact holder unit on the base, and in that the end shields are provided with openings.

In a convenient realization method, the base is fitted in its two extremities—upper and lower respectively—with a contact holder unit and connector, the said unit comprising the sockets arranged on the lower end shield and connected by conducting wires to connector lugs. A cylindrical protective shield for the chamber is fixed on the upper part of the base. Conveniently the anode is in stainless steel, the two end shields are in Teflon (PTFE), in ceramics or a mixed material (ceramics+Teflon), and the cathode comprises a platinum wire, for example 0.05 mm in diameter.

The present invention equally concerns an activity measuring channel for a β radiation gas emitter, comprising such an ionization chamber, a pre-amplification unit assembled just behind the ionization chamber, offset signal process electronics and a connector cable between the pre-amplification unit and the process electronics. Conveniently the pre-amplification unit makes an analog to digital conversion.

The measuring channel can, for example, serve as a tritium measuring channel.

The present invention also concerns an implementation process for this ionization chamber such as provided by one of the three following variants, in which a heat current is circulated in the cathode:

- during the measurement so as to create movements of convection of the gaseous mixture to be measured,
- during the measurement so as to stabilize both the sensor temperature and impact on the hygrometry of the gaseous mixture,
- at the time of decontamination vacuum baking, as the temperature is above 400° C.

DETAILED ACCOUNT OF REALIZATION METHODS

Figure 1:
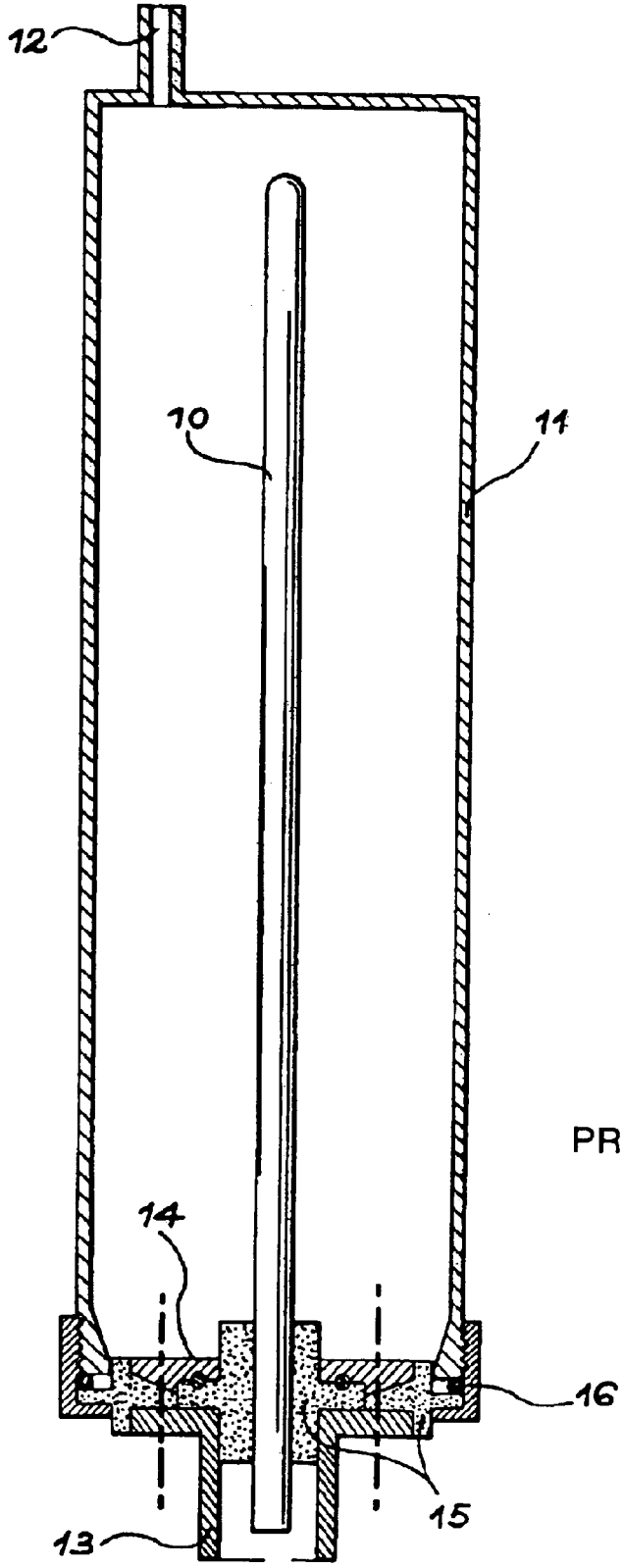
FIG. 1 PRIOR ART
FIGS. 1 and 2 illustrate two ionization chambers of the previous technology.
Figure 2:
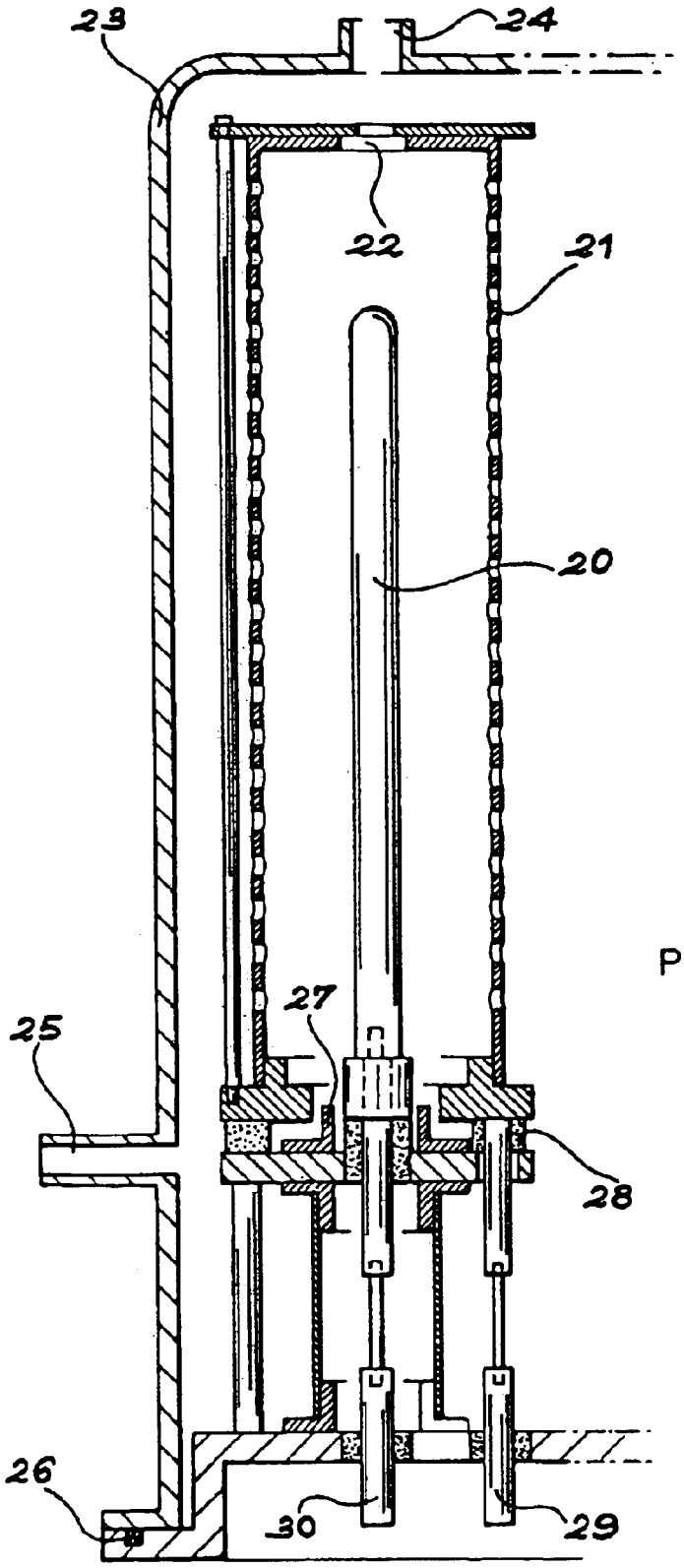
FIG. 2 PRIOR ART
Figure 3:
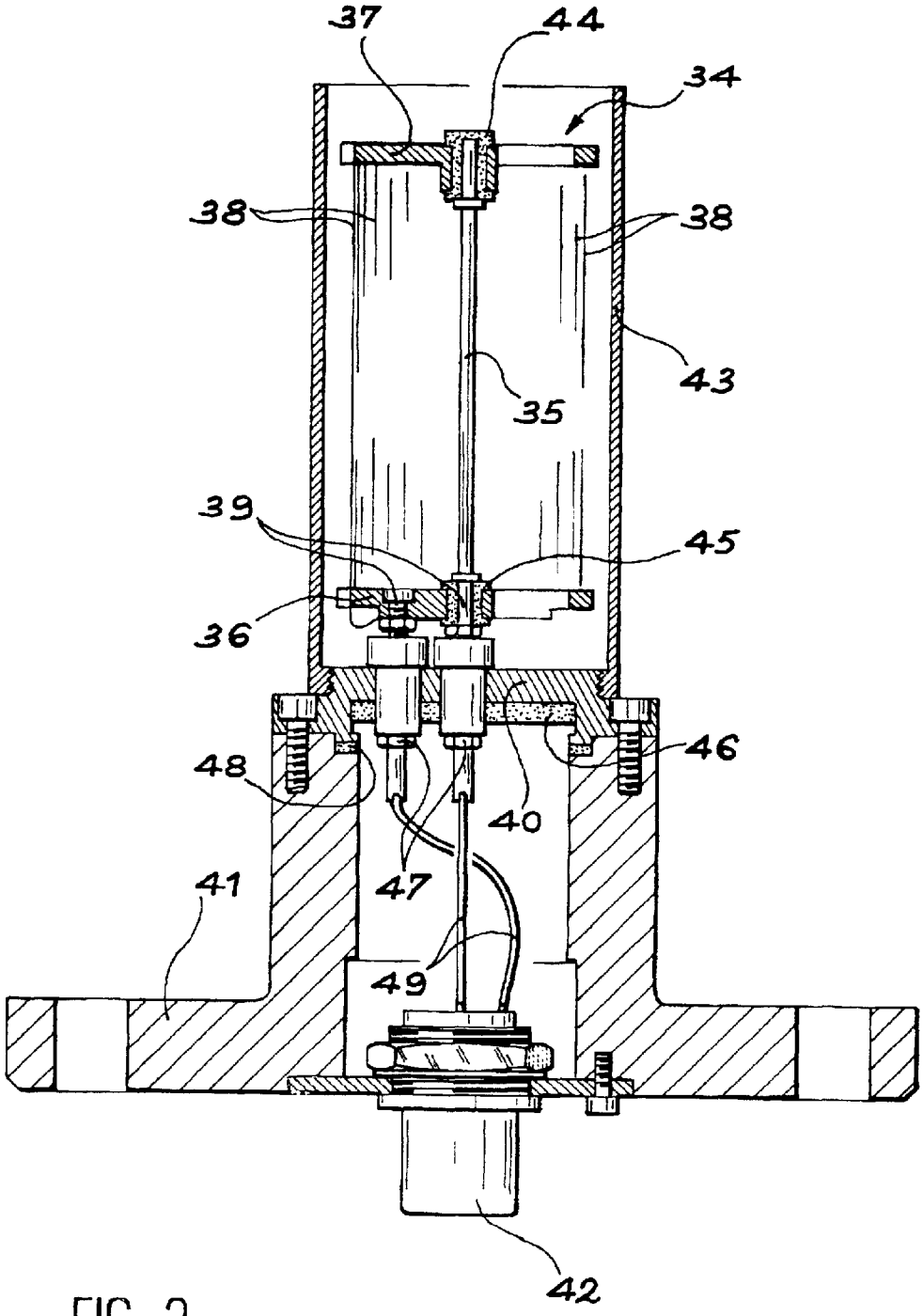
FIGS. 3 and 4 illustrate the ionization chamber of the invention.
Figure 4:
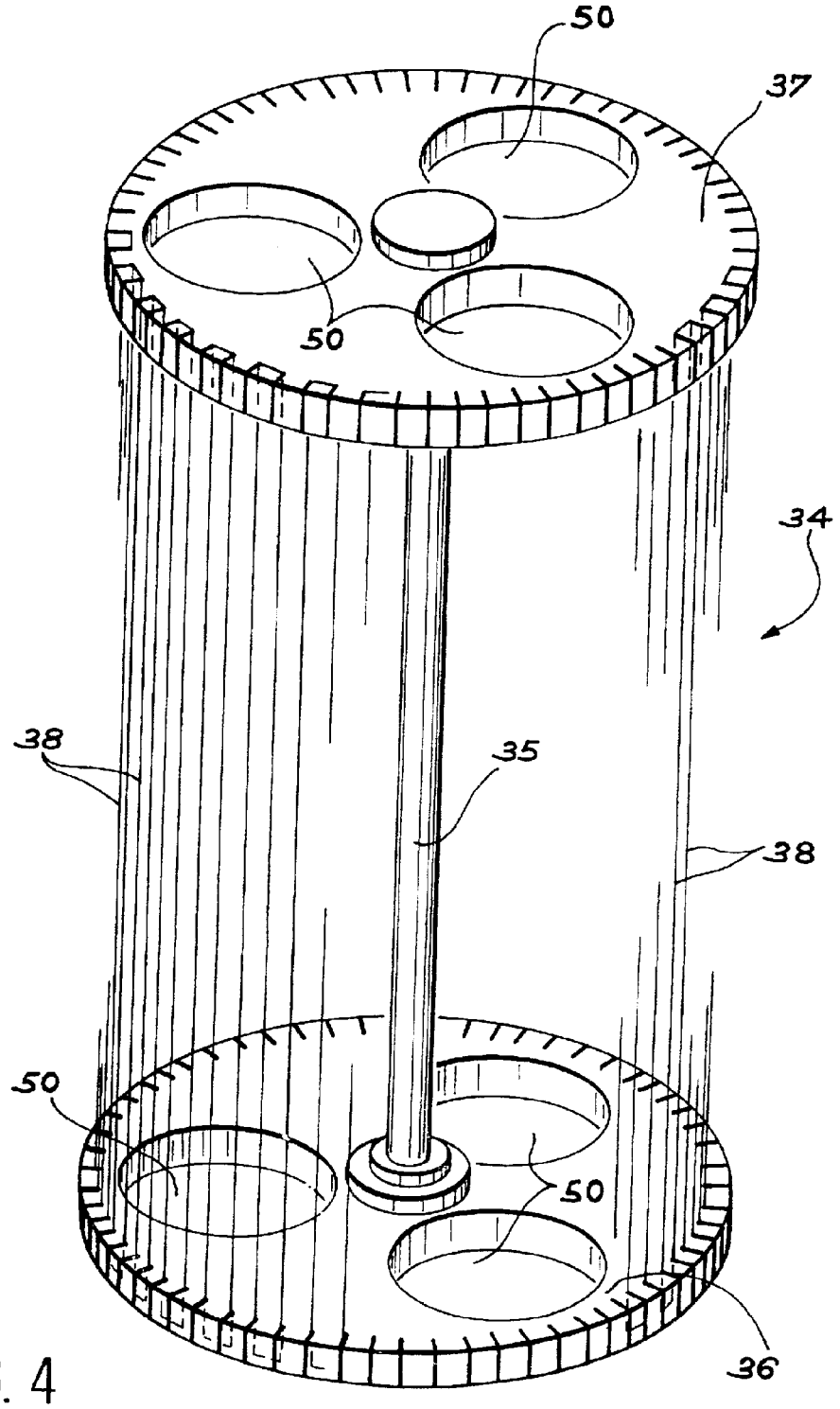

As illustrated in FIGS. 3 and 4, an ionization chamber 34 according to the invention, cylindrical in shape, comprises a central anode 35 formed by a rod in current-carrying material, for example stainless steel, two cylindrical end shields, lower 36 and upper 37 in non-magnetic and insulating material, for example in ceramics, PTFE (Teflon) or mixed material (ceramics+PTFE), centred on the anode 35 and arranged at right angles to this at its two ends, and a cathode 38 formed by a wire in conductive material, for example platinum, spooled on the outer rim of these two end shields 36 and 37, in this way to wrap round the anode 35. As illustrated in FIG. 4, these two end shields 36 and 37 are provided respectively with three circular openings 50, which has the advantage of making the structure lighter and reducing the surface that could become contaminated.

The anode 35, at its lower extremity, is connected first to a pin plug 39. The two extremities of the wire forming the cathode 38 are connected to two other pin plugs 39 arranged on the lower end shield 36.

This FIG. 3 also illustrates a connector flange 41 forming the mechanical base equipped at its two extremities, upper and lower respectively, with a contact-holder unit 40 and a connector 42. The unit 40 comprises sockets 47, for example four in number suitable for connection of the pin plugs 39, for example four, arranged on the lower end shield 36 and connected by conductor wires 49 to connector lugs 42, the chamber 34 being in this way removable. A cylindrical protective shield 43 is fixed on the upper part of the flange 41, which is dismantled in measurement phases. Also represented are a ring 45 and a nut 44 to facilitate the fixing of end shields 36 and 37 on the anode, a bushing 46 and a stainless steel plated seal 48.

Such a structure facilitates resolving various problems which appear in the devices of today's technology:

- the end shields 36 and 37 keep levels of background noise to less than $5.10^{-14}$ A which is indispensable for the measurement of low currents,
- the end shields 36 and 37 avoid any recourse to a guard ring structure to accurately delimit the electric field lines in the chamber,
- the spooled cathode 38 in extremely thin wire, for example 0.05 mm diameter, results in dividing the active surface of the chamber by a certain number x, for example 16.

Such a winding means tending towards a notion of "inessential electrode" which would evidently be ideal for eliminating surface contamination. Results obtained show a reduction in the background noise due to the surface contamination. Apart from the reliability of measurements which is improved, the cost of corrective maintenance is also reduced to the minimum because detectors are replaced less frequently,

- decontamination of the ionization chamber 34 by baking at 400° C. under vacuum is possible. The end shields must therefore be in ceramics because of resistance both to temperature and to non-degassing in the vacuum boundary,
- the fact that the cathode 38 is a winding of the interleaved type gives three possibilities of ionization chamber implementation:
  - the circulation of a heater current during measurement so as to create convection movements of the gaseous mixture to be measured in relation to a more homogeneous mixture.
  - the circulation of a heater current during measurement so as to stabilize temperature of the chamber and affect the hygrometry of the gaseous mixture,
  - the circulation of a heater current in the cathode at the time of a possible decontamination vacuum baking (minimum temperature required is 400° C.).
  - The self-supporting structure of the chamber 34 causes this to become a consumable element without the associated connector technology. The mechanical fixing functions of the chamber 34 on the base 41 and electrical continuity of the chamber 34 are provided by all the pin connectors 39 and socket connectors 47. This solution is made possible by the extreme lightness of the ionization chamber 34, which is for example 30 g. The cost of the ionization chamber according to the invention is about 7,000 francs as compared to 14,000 francs for a 100 $cm^3$ chamber of today's technology. Apart from the fact that such chambers are replaced less often (low surface contamination), their cost is divided by about two, and corrective maintenance on these is therefore greatly reduced.

The flange 41 is tested for leaktightness, the system can therefore be assembled on a Tritium manufacturing process without affecting its containment.

Replacement of the ionization chamber 34 in the event of very considerable background noise due to contamination or in the case of failure generates a quantity of waste of only about 30 g.

Figure 5:
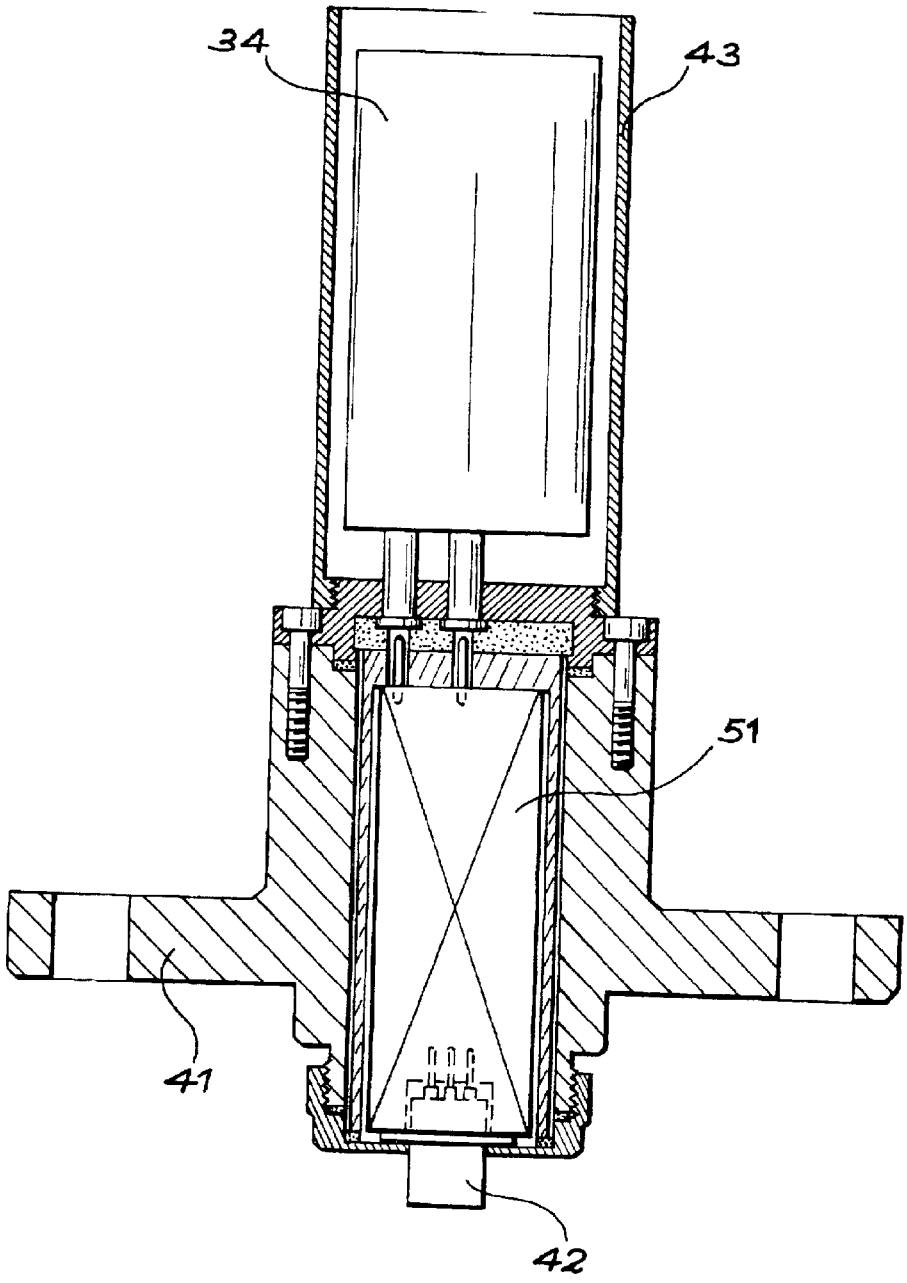
FIG. 5 illustrates the ionization chamber+pre-amplification unit according to the invention.

As illustrated in FIG. 5 a pre-amplification unit 51 can be assembled on the base 41 just behind the ionization chamber 34. This facilitates amplifying and digitizing the signal leaving the said chamber.

To measure the current generated by the ionization chamber 34, the current collected by the electrodes of the chamber passes through a high ohmic resistor ($R \cong 10^{11}\ \Omega$). The difference of potential is then measured on the terminals of this resistor and the amperage which circulates therein is calculated.

Figure 6:
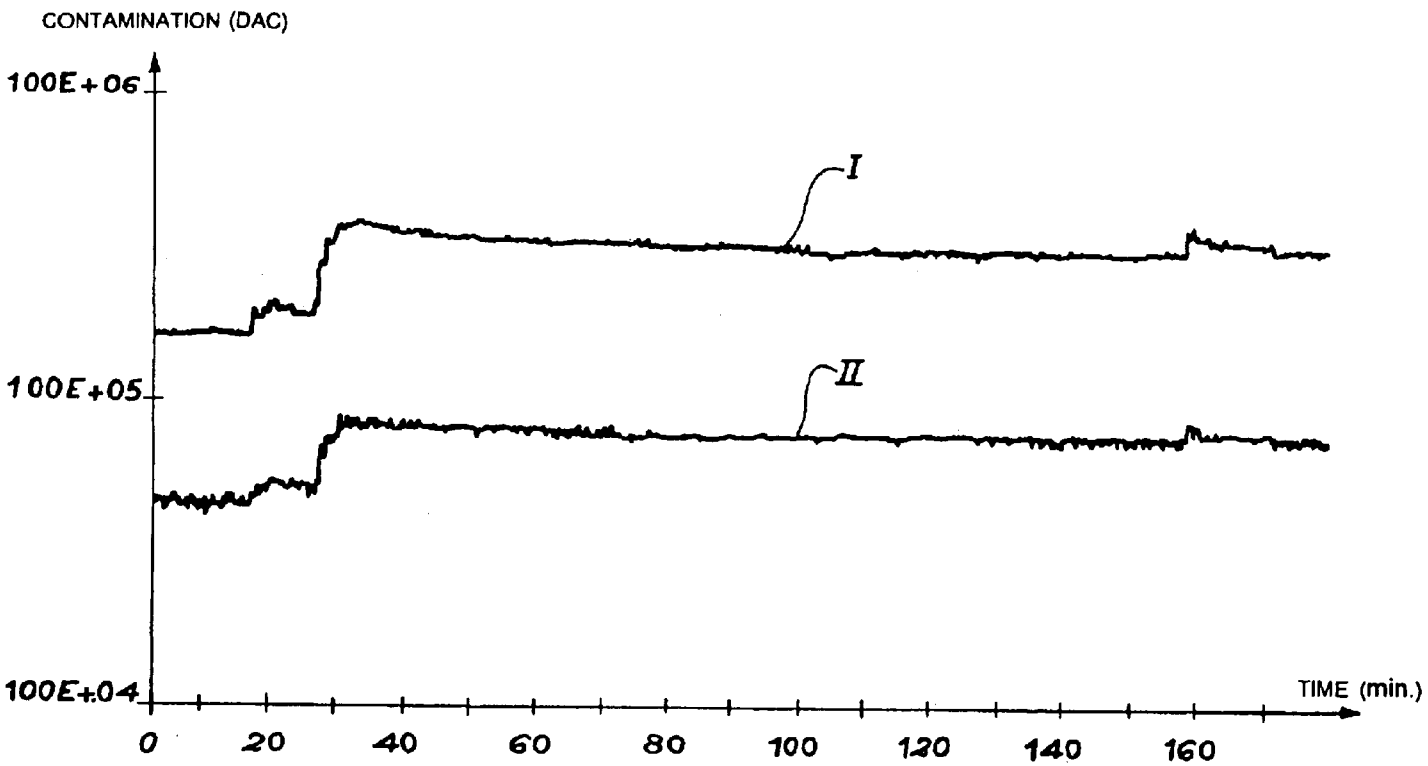
FIG. 6 illustrates comparative measurement curves attained for an ionization chamber of today's technology and for the ionization chamber of the invention.

An measurement example of this amperage is shown in FIG. 6, corresponding to a measurement of activity in a glove box in actual size, for an ionization chamber of today's technology (I) and for the ionization chamber of the invention (II). There is in fact a linearity between the two response curves obtained for a programmed contamination implementation.

Figure 7:
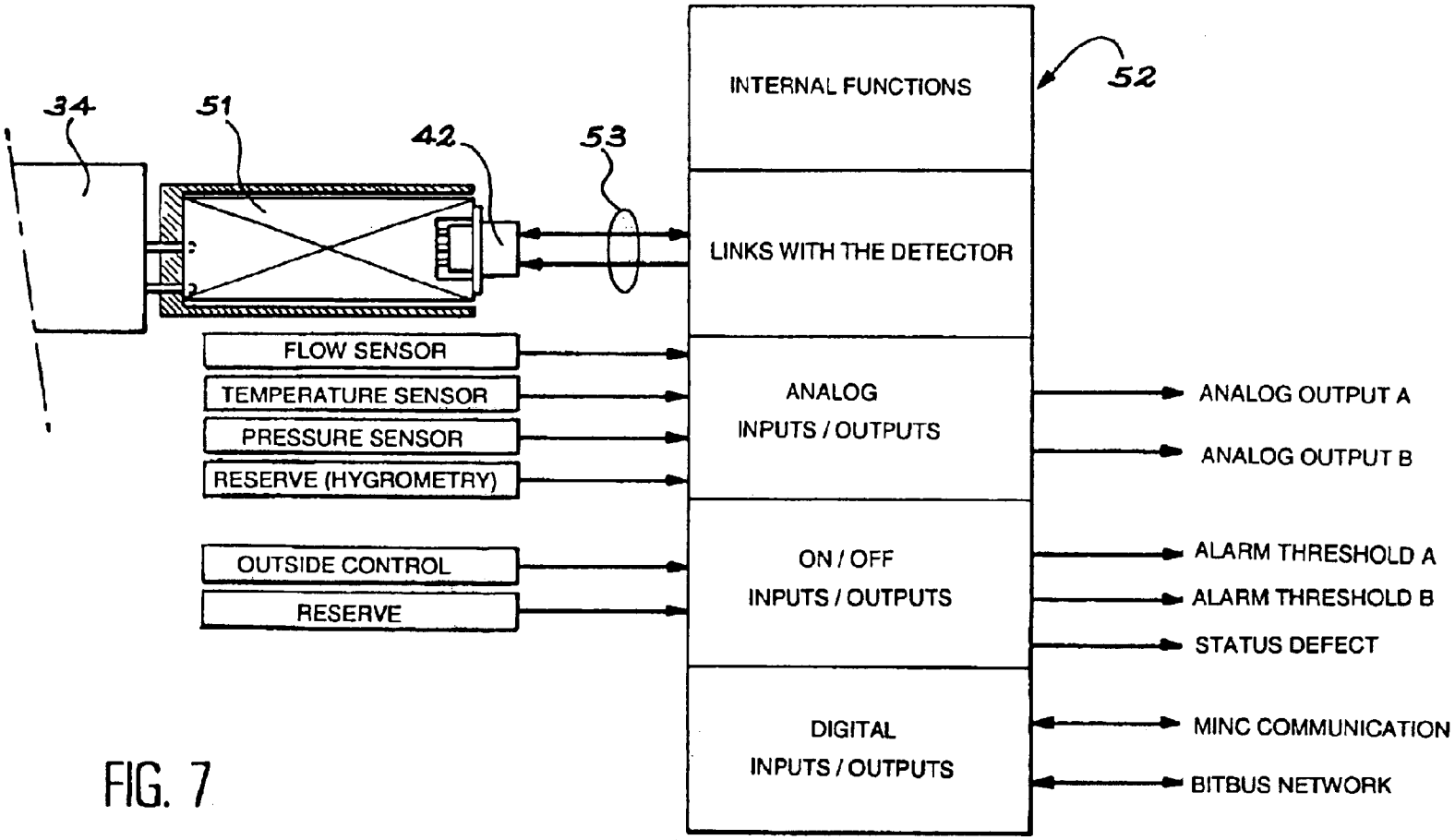
FIG. 7 illustrates the processing line according to the invention.

The activity measuring channel of a β radiation gas emitter according to the invention, as illustrated in FIG. 7, comprises an ionization chamber 34 as described above, a pre-amplification unit 51, signal process electronics 52 and a link cable 53 between the pre-amplification unit 51 and the process electronics 52. The electronics 52 can be off-set several meters from the unit described in FIG. 5.

The process electronics 52 comprises several units:

internal functions:
- supply
- back-up clock
- ROM and RAM
- management of input keyboard and output display;

links with the ionization chamber 34
- supply of the pre-amplification unit 51,
- supply of the ionization chamber 34 (ionization voltage),
- acquisition of current and temperature values,
- generation of a heater current to the ionization chamber 34,
- switch-over of the electrodes of the ionization chamber 34;

analog inputs/outputs
- four analog inputs 4 to 20 mA corresponding to optional sensors located on input,
- two insulated analog outputs A and B, 4 to 20 mA, 500 ohms;

"ON/OFF" inputs/outputs
- two "ON/OFF" inputs not supplied,
- three inverter relay outputs 5A, 250V connected to alarm thresholds A and B and to a status defect;

digital inputs/outputs
- a RS 232 link 9600 bauds (MINC communication),
- a network interface, BITBUS for example.

The general functions provided by the pre-amplification unit 51 and the process electronics 52 are the following:

Supply the ionization chamber 34 (ionization voltage).

Produce and regulate the heater current of the chamber 34 (adjustment through resistivity of the heating wire 38).

Acquire, digitize and retransmit the ionization current.

Acquire, digitize and retransmit the temperature of the pre-amplification unit 51 for a compensation of possible thermal drift.

Correct the channel drift due to the polarization of the chamber 34, either by synchronization with outside control or by compensation of a value fixed or proportional to the contamination.

Linearly convert the ionization current into units of instantaneous activity (DAC derived air concentration, MPC maximum possible concentration, $\mu Ci/m^3$, $GBq/m^3$, or $TBq/m^3$).

Integrate the ionization current depending on different periods of time.

Acquire the analog values for flow, temperature and pressure supplied by optional outside sensors, and calculate the instantaneous flow of gas in terms of normal conditions (1013 mB, 20° C.)

Integrate the instantaneous flow calculated depending on different periods of time.

Integrate the instantaneous activity depending on the volume for an expression of contamination in $\mu$Ci, GBq or TBq over periods of 1 minute, 3 minutes, 15 minutes, 1 hour, 6 hours, 1 day, 1 week, and 4 weeks.

Retransmit the various data in the form of analog signals or digital lines.

Draw up and retransmit two contacts of threshold overshoot and manage an acknowledgement procedure with proposal for a new setting staggered and delayed through programming.

Draft and retransmit an electronics contact status.

These two units 51 and 52 facilitate the following practical advantages:

digitization of the signal which allows greater reliability of measurements and better accuracy, and which enables the line to be less sensitive to electromagnetic disturbances (above all with regard to the link cable 53). The line overall is in compliance with the new EMC standards (electromagnetic compatibility);

the change of automatic range facilitating coverage of the different, for example six, decades of the effective measurement range is now made in statics (no longer by relay), thus higher precision and increased reliability;

the compensation of temperature differences of the pre-amplification unit 51 guarantees the stability and reproducibility of the measurements;

a considerable reduction of cost price—a 44% reduction envisaged.

Figure 8:
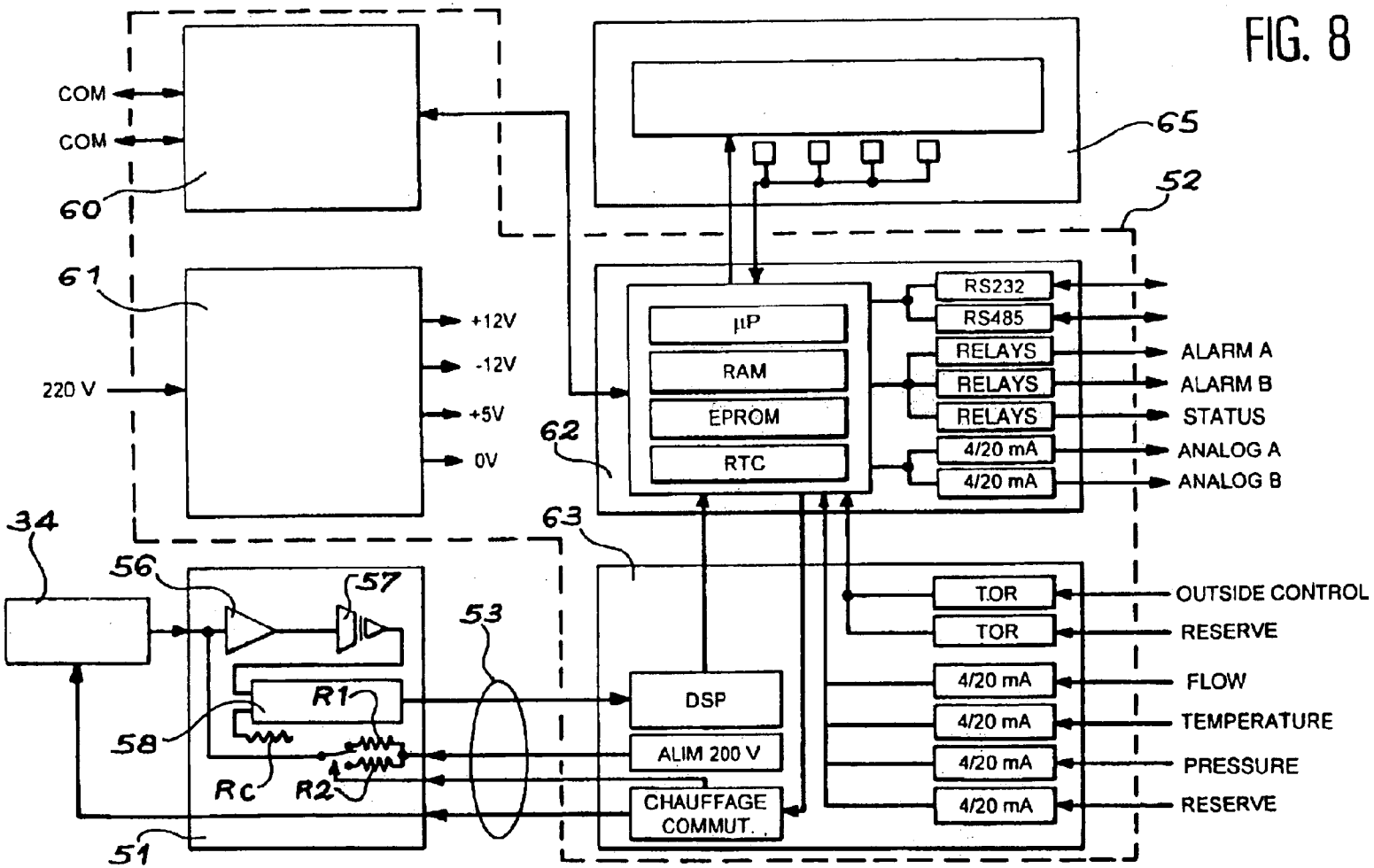
FIG. 8 illustrates an example of the line realization illustrated in FIG. 7.

FIG. 8 illustrates an example of realization of the circuits constituting the various elements of the channel, i.e.

the ionization chamber 34;

the pre-amplification unit 51 comprising an amplifier 56, an isolation amplifier 57, a 14 bits analog to digital converter 58, a compensating Rc resistor in temperature, two resistors R1 and R2 corresponding to two supply positions of the cathode;

the link cable 53;

the signal processing electronics 52 comprising:

an optional network—MINC+BITBUS 60 supply 61 which receives 220V and which delivers 0V, 6V and ±12V, a central unit 62 which comprises, for example, a $\mu$P microprocessor, random access memory, EPROM memory and a STN unit, an interface 63;

a visual display unit+keyboard 65.

REFERENCES

[1] "Tritium and other Radiogas Monitors" (Overhoff Technology Corporation)

What is claimed is:

1. An ionization device, cylindrical in shape, comprising:

a mechanical base;

an ionization chamber having an anode formed by a central rod in current-carrying material and a cathode in current-carrying material around the anode, both connected to two elements of said mechanical base, said ionization chamber being removable;

two cylindrical end shields in non-magnetic and insulating material centered on the anode and arranged at right angles to the anode at both ends, said cylindrical end shields being provided with openings, the cathode being formed of a wire spooled on the outer rim of said two cylindrical end shields; and pin plugs arranged on the lower end shield, suitable for insertion into sockets arranged on a contact-holder unit of said mechanical base, the lower extremity of the anode and two ends of the wire forming the cathode being connected to said pin plugs.

2. An ionization device according to claim 1, in which the base is provided at its two extremities—upper and lower respectively—with a contact-holder unit and a connector, the sockets being connected by conducting wires to connector lugs.

3. An ionization device according to claim 2, in which a cylindrical protective shield for the chamber is fixed on the upper part of the base.

4. An ionization device according to claim 1, in which the anode is in stainless steel.

5. An ionization device according to claim 1, in which the two end shields are in Teflon.

6. An ionization device according to claim 1 in which the end shields are in ceramics.

7. An ionization device according to claim 1, in which the two end shields (36, 37) are in mixed material—ceramics+Teflon.

8. An ionization device according to claim 1, in which the cathode comprises a platinum wire.

9. An ionization device according to claim 8, in which the platinum wire has a diameter of 0.05 mm.

10. An activity measuring channel of a β radiation gas emitter comprising an ionization device according claim 1, a pre-amplification unit assembled just behind the ionization device, an electronic signal processor and a connecting cable between the pre-amplification unit and the electronic processor.

11. A measuring channel according to claim 10, in which the pre-amplification unit comprises an analog to digital converter.

12. A measuring channel according to claim 10 which is a tritium measuring channel.

13. Implementation process of the ionization device according to claim 1, in which a heater current is circulated in the cathode during measurement.

14. Implementation process of the ionization device according to claim 1, in which a heater current is circulated in the cathode at the time of decontamination vacuum baking, the temperature being above 400° C.

* * * * *